US005193426A

United States Patent [19]

Dunn

[11] Patent Number: 5,193,426

[45] Date of Patent: Mar. 16, 1993

[54] LINEAR TYPE PUNCH PRESS

[76] Inventor: David C. Dunn, 410 E. Cleveland, Guthrie, Okla. 73044

[21] Appl. No.: 746,757

[22] Filed: Aug. 19, 1991

[51] Int. Cl.[5] ..... B26D 7/02

[52] U.S. Cl. ..... 83/277; 83/282; 83/409; 83/549; 83/553; 83/618; 83/859

[58] Field of Search ..... 83/549, 405, 409, 553, 83/618, 859, 206, 277, 282, 437, 151

[56] References Cited

U.S. PATENT DOCUMENTS

| | | | |
|---|---|---|---|
| 3,448,645 | 6/1969 | Graf et al. | 83/277 X |
| 3,449,991 | 6/1969 | Daniels | 83/76.9 |
| 3,691,887 | 9/1972 | Roch | 83/277 |
| 3,717,061 | 2/1973 | Daniels | 83/409 |
| 3,815,403 | 6/1974 | Daniels | 83/151 X |
| 4,106,183 | 8/1978 | Brolund et al. | 83/409 X |
| 4,297,927 | 11/1981 | Kuroda | 83/277 X |
| 4,503,741 | 3/1985 | Hunter | 83/549 |
| 4,523,749 | 6/1985 | Kindgren et al. | 83/409 X |

*Primary Examiner*—Frank T. Yost
*Assistant Examiner*—Clark F. Dexter
*Attorney, Agent, or Firm*—Robert K. Rhea

[57] ABSTRACT

A linear punch press for punching sheet material is formed by an X axis central support frame having a coextensive laterally spaced parallel support table on either side. Medically located relative to its ends the central frame supports a punch station including fixed position punch and die adaptors which respectively support a cooperating punch and die. A workpiece supporting and positioning frame is longitudinally slidably supported by the central frame and in turn supports a punch head movable longitudinally of the central frame within the workpiece frame. A Y axis conveyor drive extends there between and is slidably supported at one end by the respective support table and is connected at its other end with the workpiece support frame for moving a workpiece transversely through the central support frame.

4 Claims, 14 Drawing Sheets

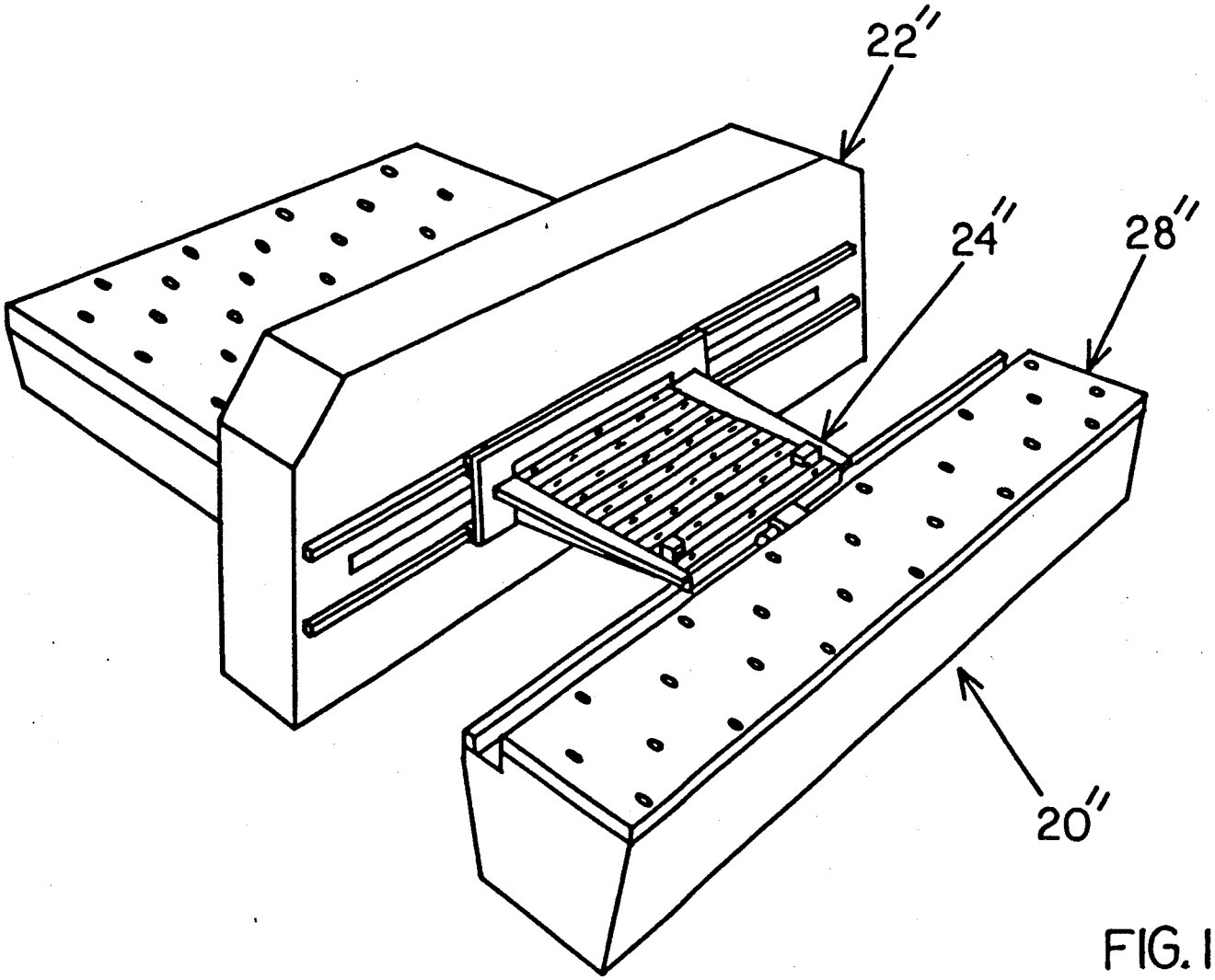
FIG. IB

LINEAR TYPE PUNCH PRESS

BACKGROUND OF THE INVENTION

1. Field of the Invention

This invention relates to industrial sheet metal processing of work pieces and more particularly to an improvement in a linear punch press.

2. Description of the Prior Art

Sheet metal punch presses having a bridge type frame supporting a punching head have been used for some time.

However, such punching machines have usually been equipped with turret-type punching heads or cartridge-type punch and die sets moved into position with respect to a punching head or a ram. Both the turret-type and the cartridge-type die holding systems are subject to numerous disadvantages: such as the use of an alignment pin to align a punch and die; and, the use of gears, pulleys, chains and clutches, all having many wear points resulting in a misalignment of punches and dies as well as damaging a workpiece or structural components of the punch press.

U.S. Pat. No. 3,449,991, issued Jun. 17, 1969, to Daniels is an example of a punch press utilizing turrets for guiding the tooling into position for punching by a ram means.

U.S. Pat. No. 4,503,741, issued Mar. 12, 1985, to Hunter is an example of a bridge-type punching frame that features elongated sectionalized cartridges which carry the tooling and die cartridges and are moved together in a linear fashion.

SUMMARY OF THE INVENTION

An elongated horizontally disposed workpiece central frame is interposed in spaced parallel relation between two elongated coextensive workpiece support tables and forms the X axis for workpiece X Y axis movement. Medially its ends the central frame supports a punch station comprising a plurality of fixed position punch and die adaptors which respectively support cooperating punches and dies.

A workpiece supporting and positioning frame for movement of the workpiece in the X axis direction is longitudinally slidably supported by the central frame and in turn supports a punch head moveable longitudinally of the central frame within the workpiece frame. A bridge frame extending between the respective workpiece support table and the workpiece frame are movable longitudinally of the central frame and support tables and respectively support Y axis conveyors for moving workpieces through the workpiece frame into position for work-piece punching by the punch head.

The principal object of this invention is to provide an improved linear-type punch press having punch and die adaptors permanently mounted in a fixed position and a movable punching head processing a workpiece interposed between punches and dies.

BRIEF DESCRIPTION OF THE DRAWINGS

FIG. 1B is a perspective view of a further embodiment;

DESCRIPTION OF THE PREFERRED EMBODIMENTS

Figure 1:
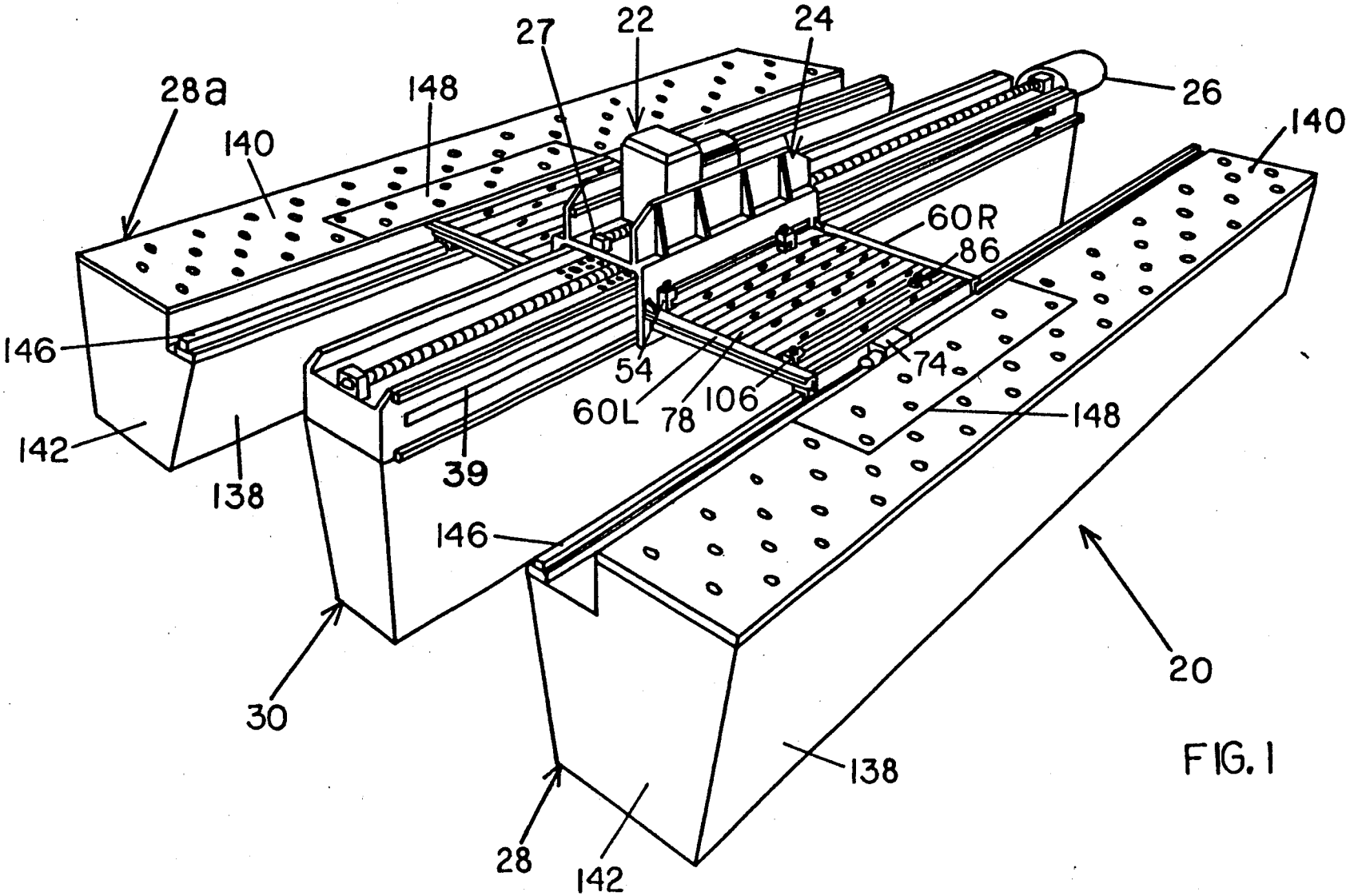
FIG. 1 is a perspective view of the preferred embodiment of the linear punch press.

Like characters of reference designate like parts in those figures of the drawings in which they occur.

In the drawings:

The reference numeral 20 indicates the punch press as a whole, which principally comprises a punch head 22, X and Y axes positioning frame 24, a central support frame 30, support tables 28 and **28*a*, X axis servo drive and ball screw 26 and X axis punch head servo drive and ball screw 27**.

Figure 5:
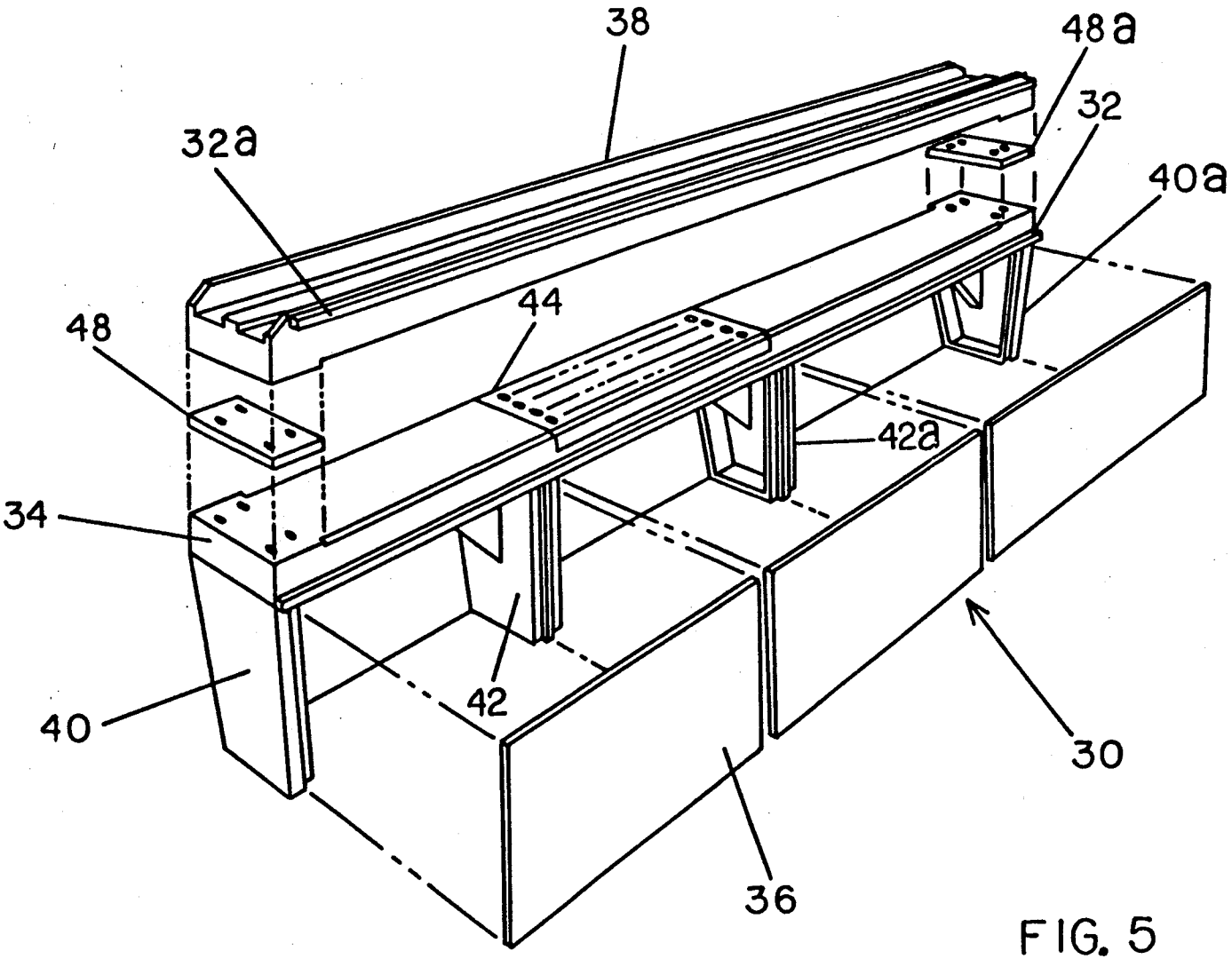
FIG. 5 is a partially exploded perspective of the central support frame.

The support frame 30 (FIG. 5) consists of outer end base legs 40 and **40*a* and inner base legs 42 and 42*a* depending from and supporting a lower die support 34. End spacer plates 48 and 48*a* overlying the lower die support 34 support an upper punch support 38 and define a central frame opening 39 (FIG. 3**) for the passage of workpieces, as presently explained.

The outer base legs **40–40*a* and inner base legs 42–42*a* provide excellent rigidity and support for the lower die support 34 and upper punch support 38. A plurality of base panels 36 extend between base legs 40–42, 42–42*a*, and 42*a*–40*a***, respectively.

Linear guides 32 and **32*a* are secured to respective sides of the upper punch support 38 and the lower die support 34 for slidably supporting the positioning frame 24**.

Figure 6:
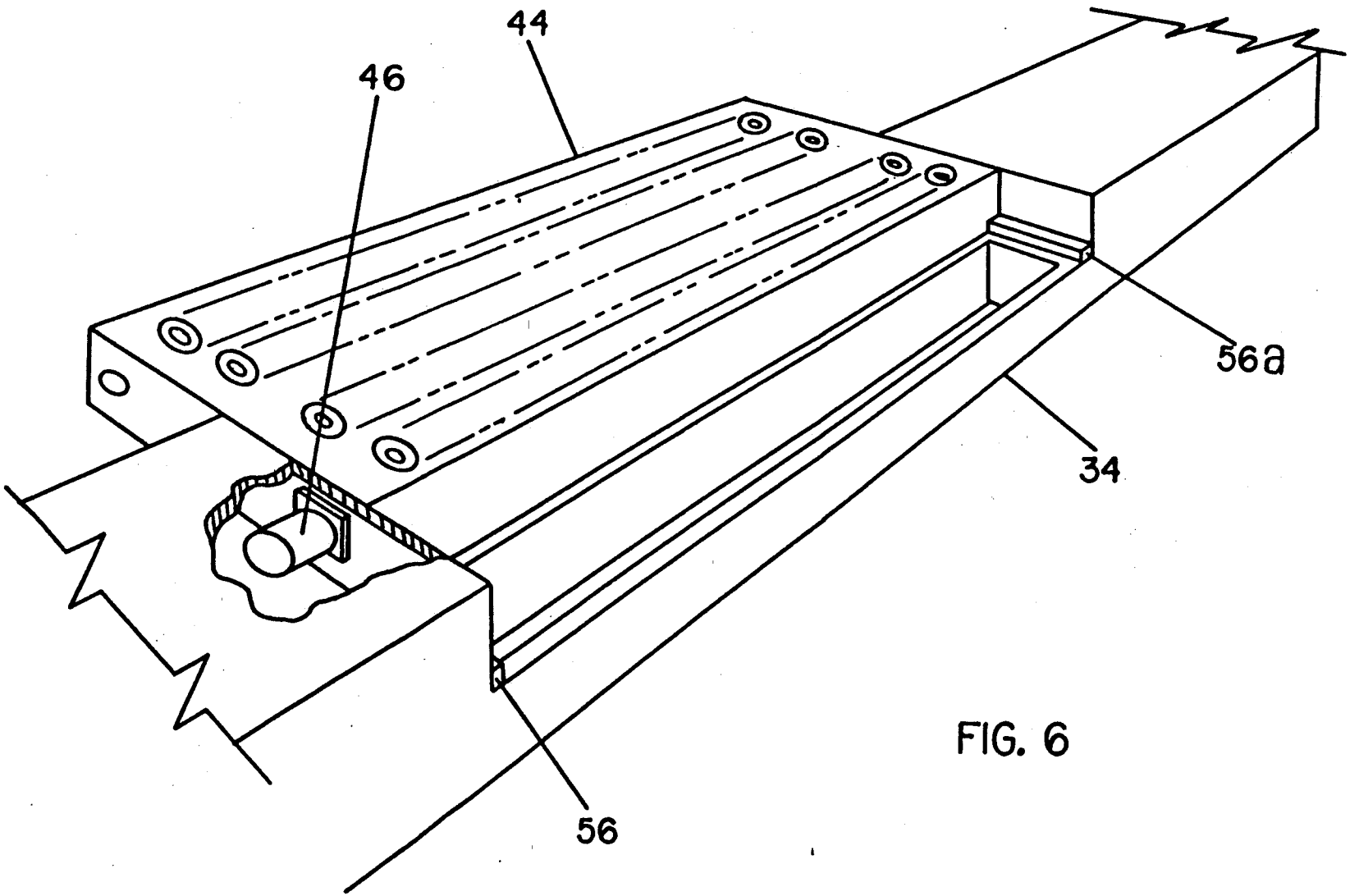
FIG. 6 is a fragmentary perspective view, to a larger scale, of the die support with parts broken away for clarity and the die housing extended for die replacement.
Figure 7:
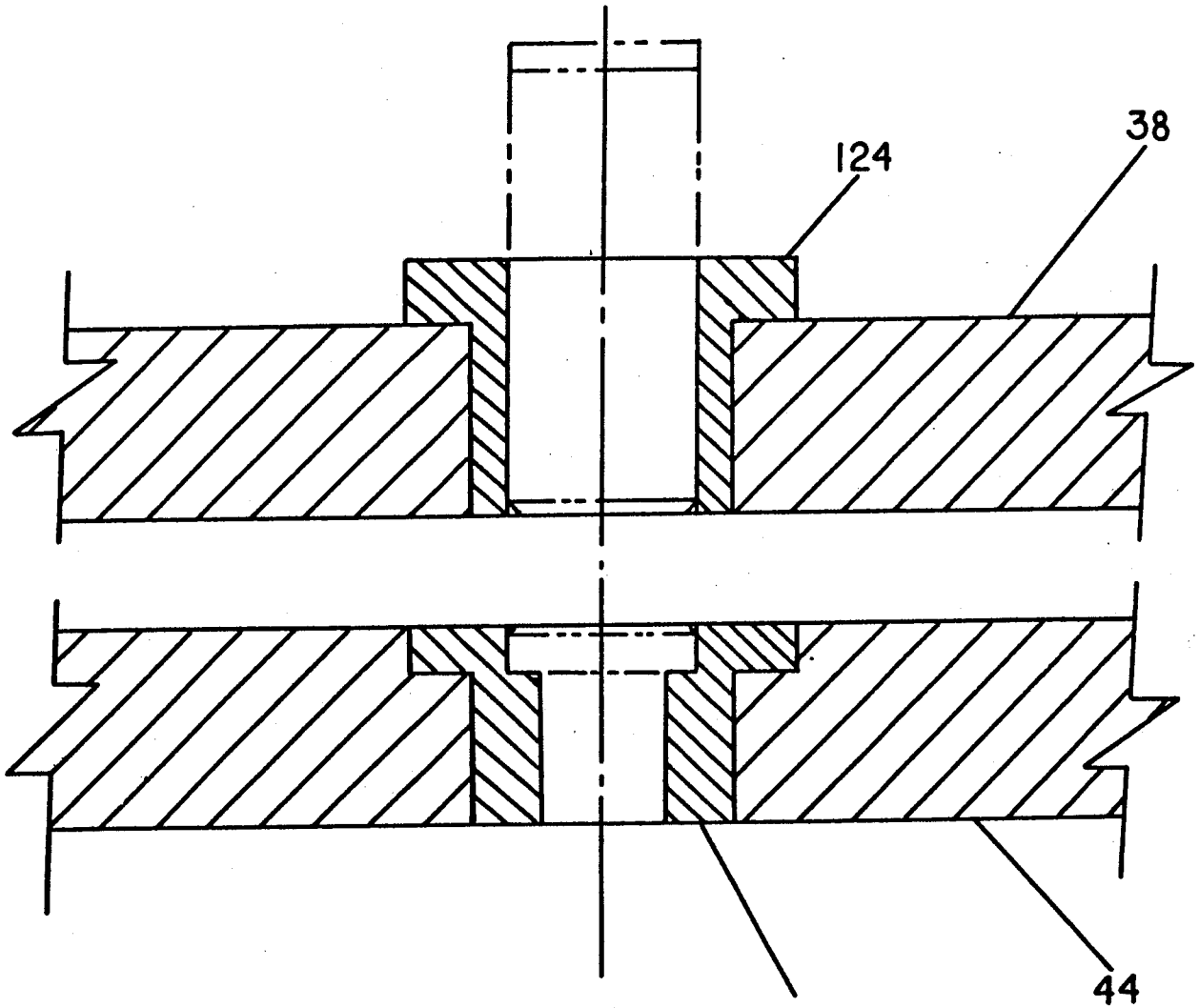
FIG. 7 is a fragmentary cross section view to an enlarged scale of punch and die adaptors in their respective supports and illustrating, by phantom lines the relative position of a punch and die.

A die housing 44 supported by transverse roller guides 56 and **56*a* (FIG. 6) is mounted on the lower die support 34 and held in place by a power driven plunger 46. A punch adaptor 124 (FIG. 7) is secured in fixed position to the upper punch support 38 and a die adaptor 126 is secured in fixed position to the die housing 44. Positive alignment of the punch adaptor 124 and the die adaptor 126 is assured by line drilling through the upper punch support 38 and the die housing 44. The die housing 44 moves on the transverse roller guides 56 and 56*a* (FIG. 6) and allows the die housing to move to either side of the lower die support 34 for installing or replacing dies and adaptors 126. After installing dies or adaptors the power cylinder 46 repositions the die housing so the die adaptors 126 are in line with the respective punch adaptor 124** for punching workpieces.

Figure 3:
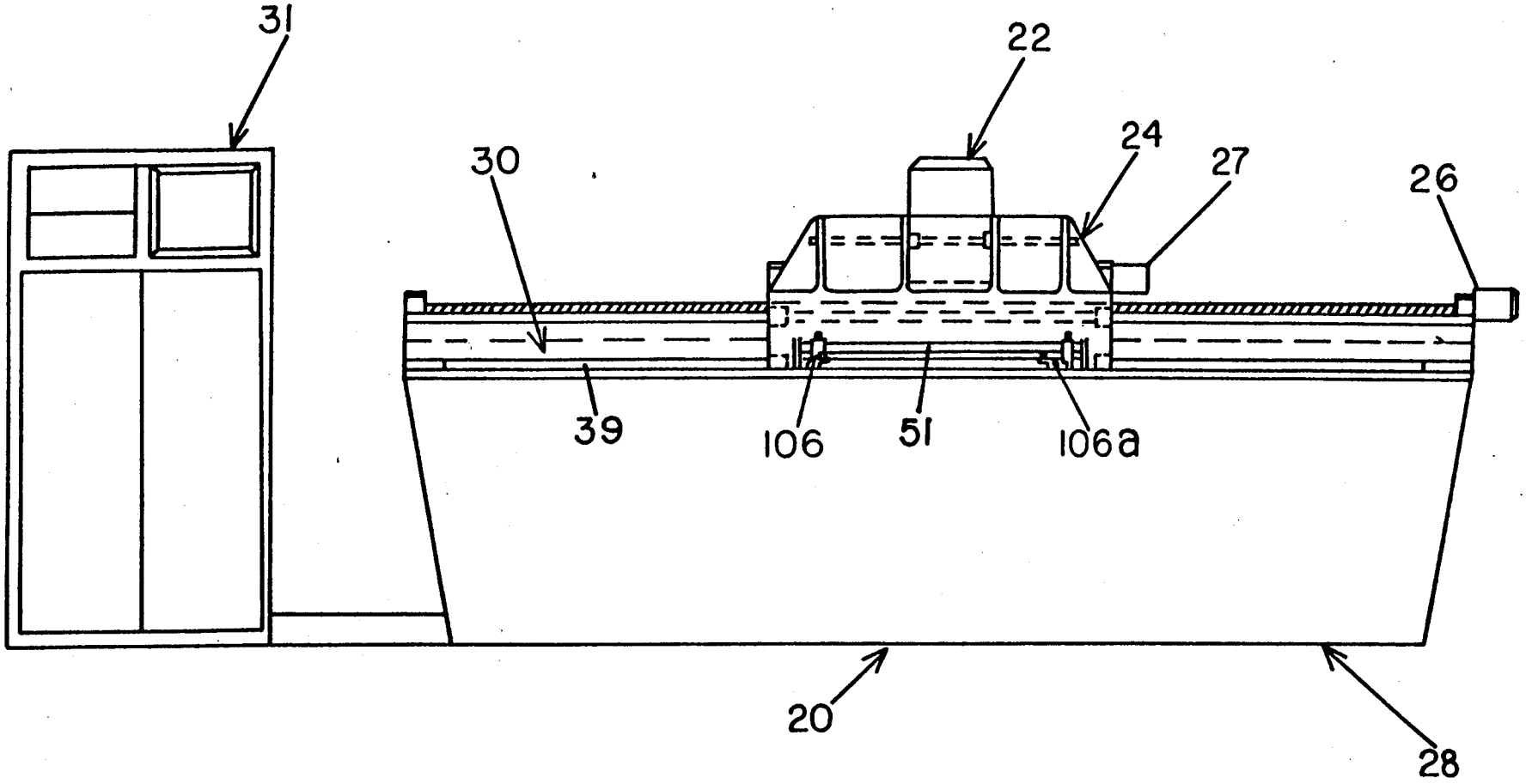
FIG. 3 is a side elevational view of the punch press and its controller.

The X and Y axes positioning frame 24 (FIG. 8) includes support sides 60L and 60R secured, at one end, to respective depending outer surfaces of a generally H-shaped, in end view, X axis frame 50 normal to and centered at respective ends of slots 51, only one being shown, (FIG. 3). A plurality of vertical gussets 62 and horizontal gussets 64 respectively secure the top and sides of the support sides 60L and 60R to the frame 50. A support 84 extends between the other ends of the support sides 60L and 60R. Workpiece repositioning clamps 54 and 54a are fastened to the exterior of the frame 50. A plurality of linear guides 80 are mounted on the upper inner surface of the frame 50 and a plurality of X axis linear guides 82 are secured in confronting relation on the inner surfaces of the lower part of the frame 50. The linear guides 82 are positioned to receive the slides 32–32a and accurately align and move the X and Y positioning frame 50 on the central support frame 30. An X axis servomotor and screw assembly 26 (FIGS. 1 and 4) is mounted on support frame 30 for moving the workpiece positioning frame 24.

Figure 8:
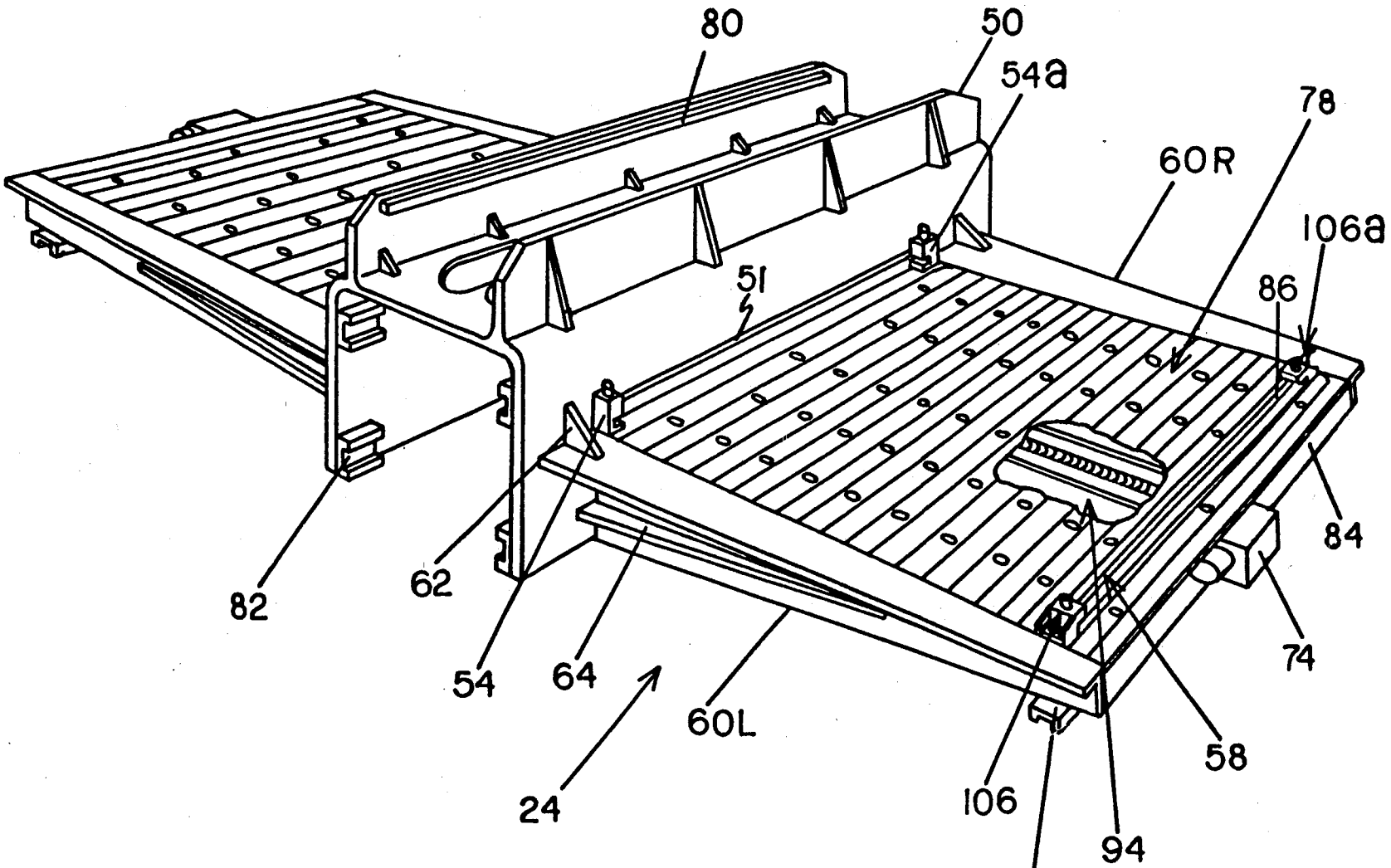
FIG. 8 is a perspective view, to a different scale, with parts broken away for clarity of the X and Y positioning frame.
Figure 9:
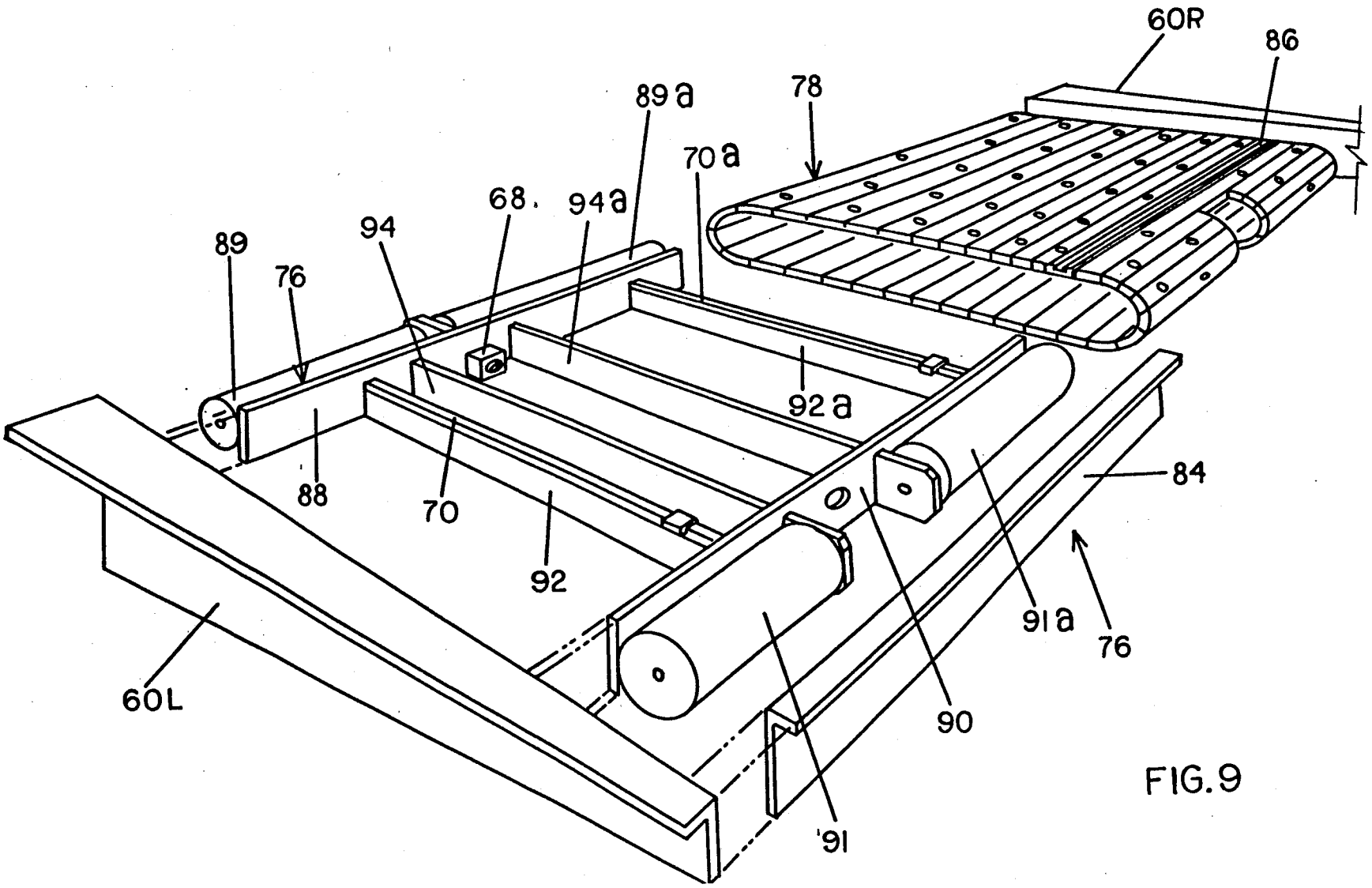
FIG. 9 is an exploded perspective view of the Y axis frame and conveyor.
Figure 10:
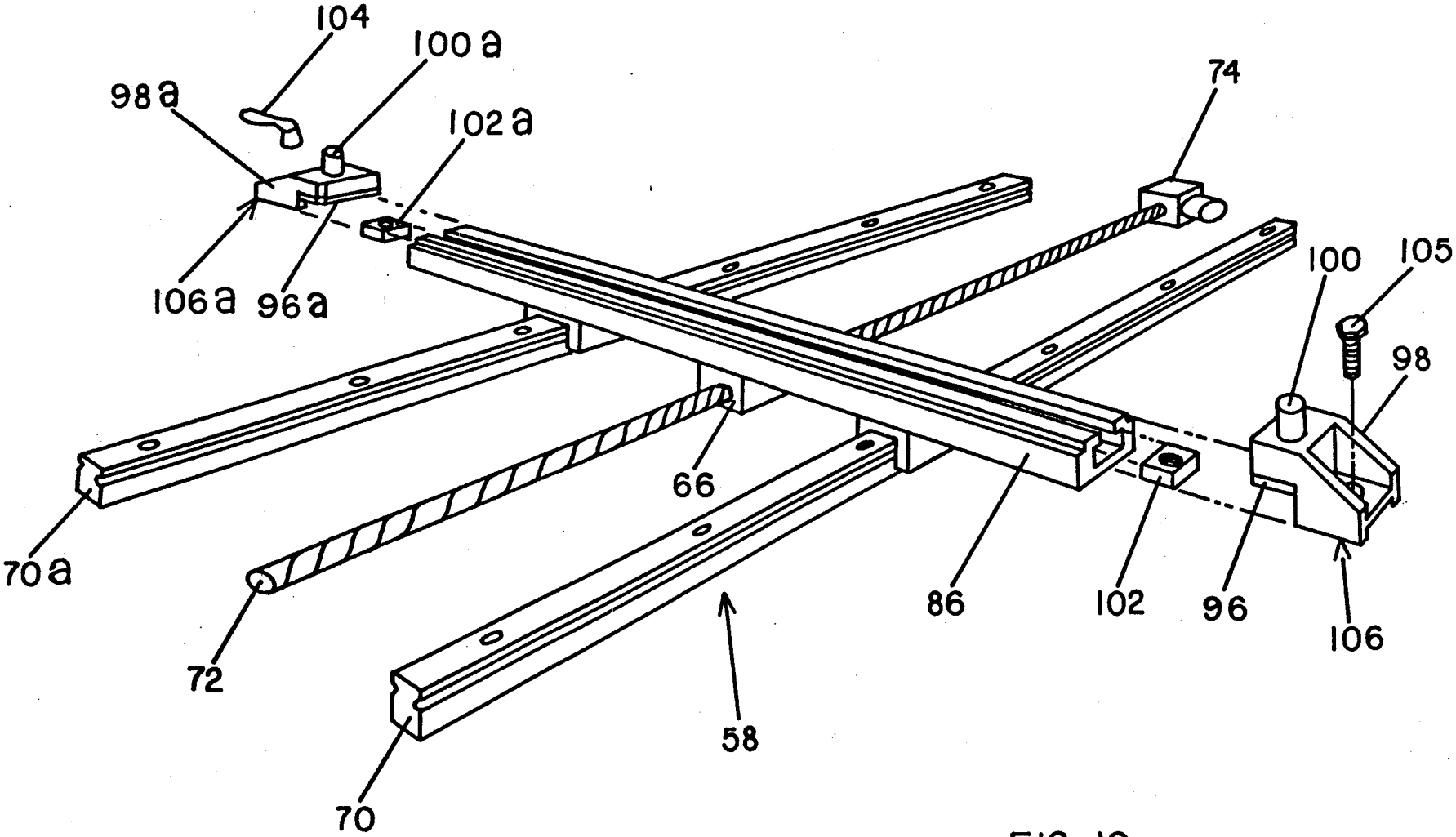
FIG. 10 is a partially exploded perspective view, to an enlarged scale, of the Y axis drive and clamps.

A Y axis frame assembly 76 (FIGS. 8 and 9) is secured between the side supports 60L and 60R. A conveyor 78 is rotatable under and over the Y axis frame 76 and its ends are snapped together by a bar 86. The Y axis drive screw 72 (FIG. 10) extends from a servomotor 74 through the conveyor 78 to a bearing 68 (FIG. 9). A block 66 (FIG. 10) on the clamp 86 receives the screw 72 for moving the conveyor 78. Linear slides 82a are secured to the depending surface of the outward end portion of the support sides 60L and 60R for the purpose presently explained. The Y axis frame 76 includes front roller supports 88 and rear roller supports 90 connected in parallel spaced relation by linear guide supports 92 and 92a and center supports 94 and 94a. Front rollers 89 and 89a and rear rollers 91 and 91a are respectively mounted on the front and rear roller support 88 and 90. Y axis linear guides 70 and 70a are mounted on the linear guide supports 92 and 92a. The ball screw bearing 68 is mounted on the front roller support 88 opposite the front rollers.

The conveyor 78 is formed by conventional juxtaposed aluminum slat extrusions joined to each other along their longitudinal side edges. The conveyor forming slats are manufactured by Alco Aluminum Extrusion and are available from aluminum supply outlets. The Y axis drive and workpiece clamp assembly 58 including the bar 86 is supported by the li-near guides 70 and 70a.

Brackets 98 and 98a (FIG. 10) having gripping jaws 96 and 96a and power cylinders 100 and 100a are assembled on respective end portions of the bar 86 to form workpiece camp assemblies 106 and 106a. Nuts 102 and 102a, a screw 105 and a clamping handle 104 respectively adjustably secure the clamp assemblies to the bar 86.

Figure 11:
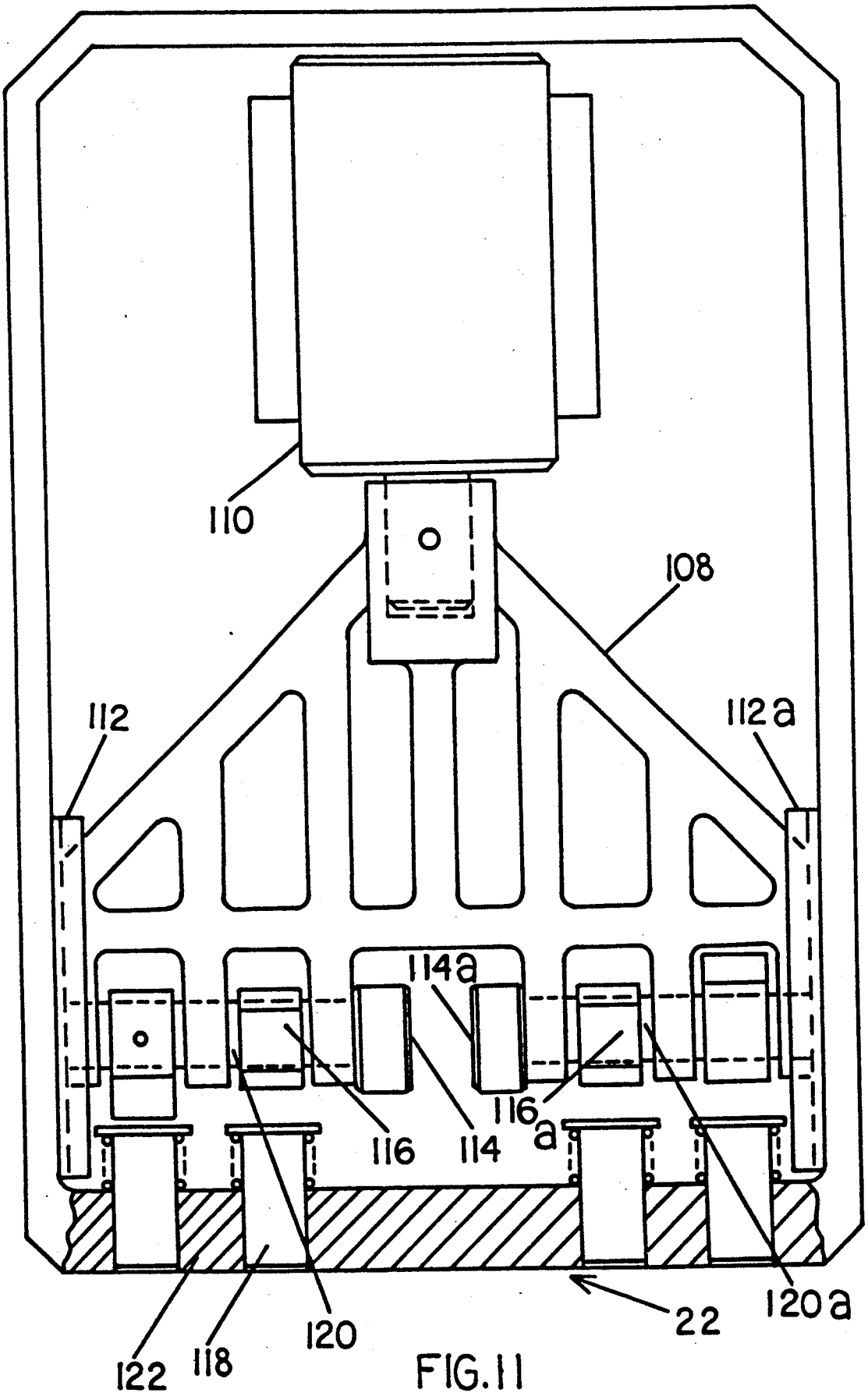
FIG. 11 is an enlarged front view, partially in cross section, of the punching head with the cover and other parts omitted for clarity.

Referring to FIG. 11, a direct current stepper motor 114 is axially mounted on a horizontal cam 120 journalled by bearings at one side of the depending end portion of a plate-like interposer 108 vertically reciprocated in a punch head housing 122. A plurality of interposer cams 116 are rotatable by the shaft 120 in cooperating downwardly open slots formed in the depending end portion of the interposer 108. A plurality of workpiece punching rams 118 are vertically slidable in bushings in the depending portion of the punch head housing 122. A second stepper motor 114a, cams 116a, and shaft 120a are similarly mounted in the other side of the interposer 108. The interposer 108 and punching ram 110 are coupled together and contained by the punching head housing 122. Staggered rows of punches are unnecessary since either cam 116 or 116a may be selected, therefore, a greater punch and die density may be utilized. Gibs 112 and 112a guide the respective sides of the interposer 108 and are secured to the walls of the punching head housing 122. An X axis servomotor and screw assembly 27 is mounted on the frame 24 for moving the punch head housing 122 in an X axis direction. All screws, support bearing guides, and slides with servomotor drive are available from NSK Corporation, 3861 Research Park Drive, Ann Arbor, Mich. USA 48108.

Figure 12:
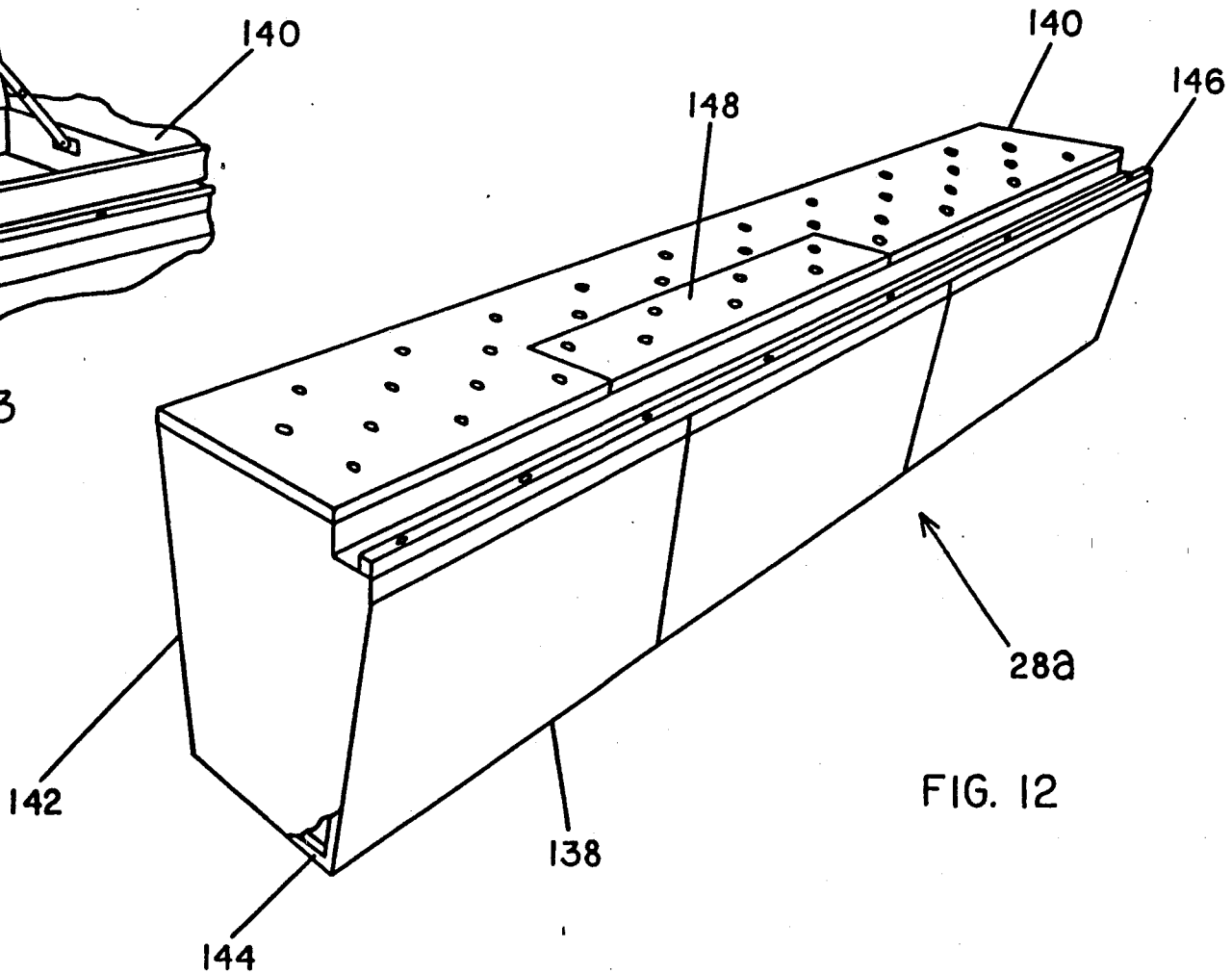
FIG. 12 is a perspective view of one support table.
Figure 13:
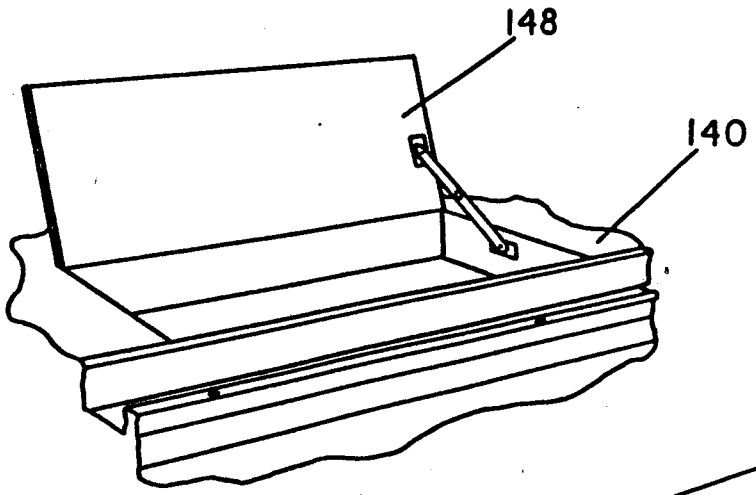
FIG. 13 is a fragmentary perspective view of a punch and die storage compartment with its door open.

The loading and unloading support tables 28 and 28a (FIGS. 1 and 12) are respectively formed by rectangular frames 144 having a plurality of overlying end panels 142 and side panels 138 and a horizontal support top 140. X and Y axes positioning frame 24 linear guide supports 146 are longitudinally mounted on confronting surfaces of the tables 28 and 28a. The positioning frame linear guides 146 (FIG. 1) provide accurate alignment and support for the positioning frame 24 in the X axis direction by the cooperating X axis linear slides 82a (FIG. 8). The top 140 is provided with a hinged die door 148 covering a punch and die storage compartment.

Figure 1A:
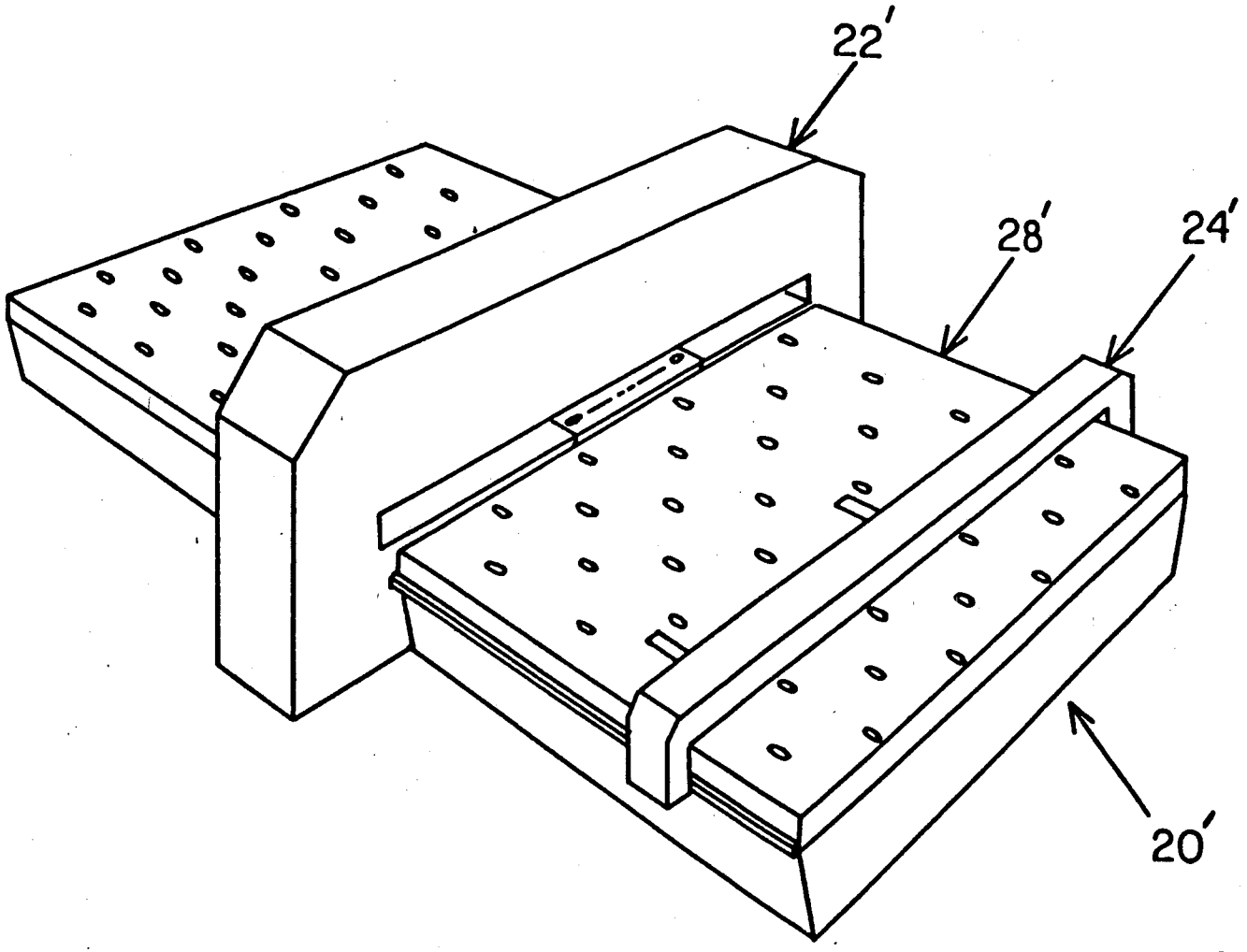
FIG. 1A is a perspective view of another embodiment.
Figure 2:
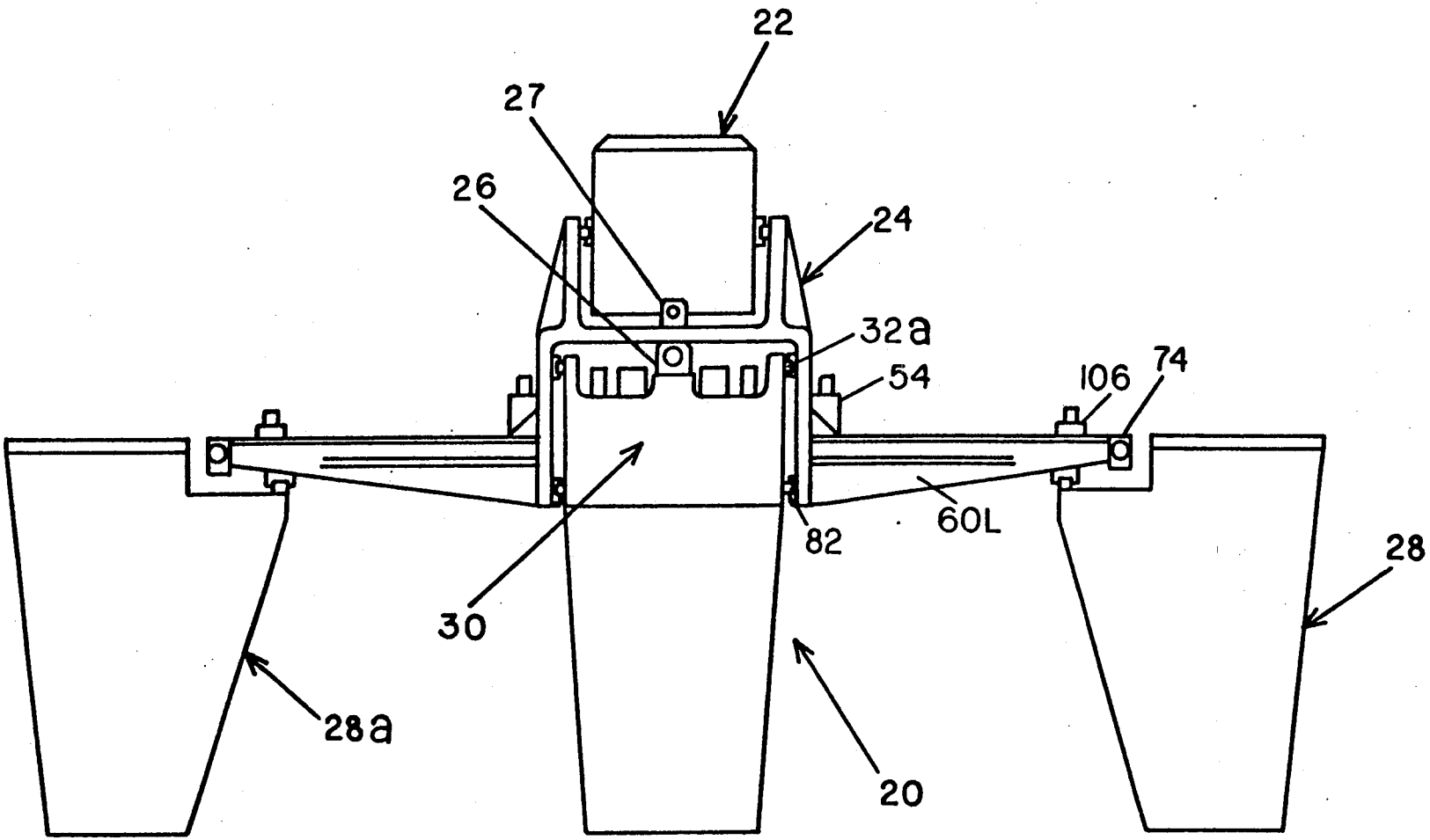
FIG. 2 is a left end view of FIG. 1.

Another embodiment of a linear-type punch press is indicated at 20' (FIG. 1A) in which a bridge-type frame 22' supporting a cooperating plurality of fixed position punches and dies extends transversely of a workpiece path. A workpiece positioning frame 24' is slidably supports by a work table 28' projecting laterally from the bridge frame 22'.

Another embodiment of a linear-type punch press is indicated at 20" (FIG. 1B) in which a similar bridge-type frame 22" supports a plurality of fixed position cooperating punches and dies. A work support table 28" similar to the work support tables 28 and 28a is positioned at one side of the bridge frame 22" in spaced-apart relation and supports one end of a workpiece positioning X Y axes frame 24" cooperatively supported in sliding relation by the bridge-type frame 22".

OPERATION

Figure 4:
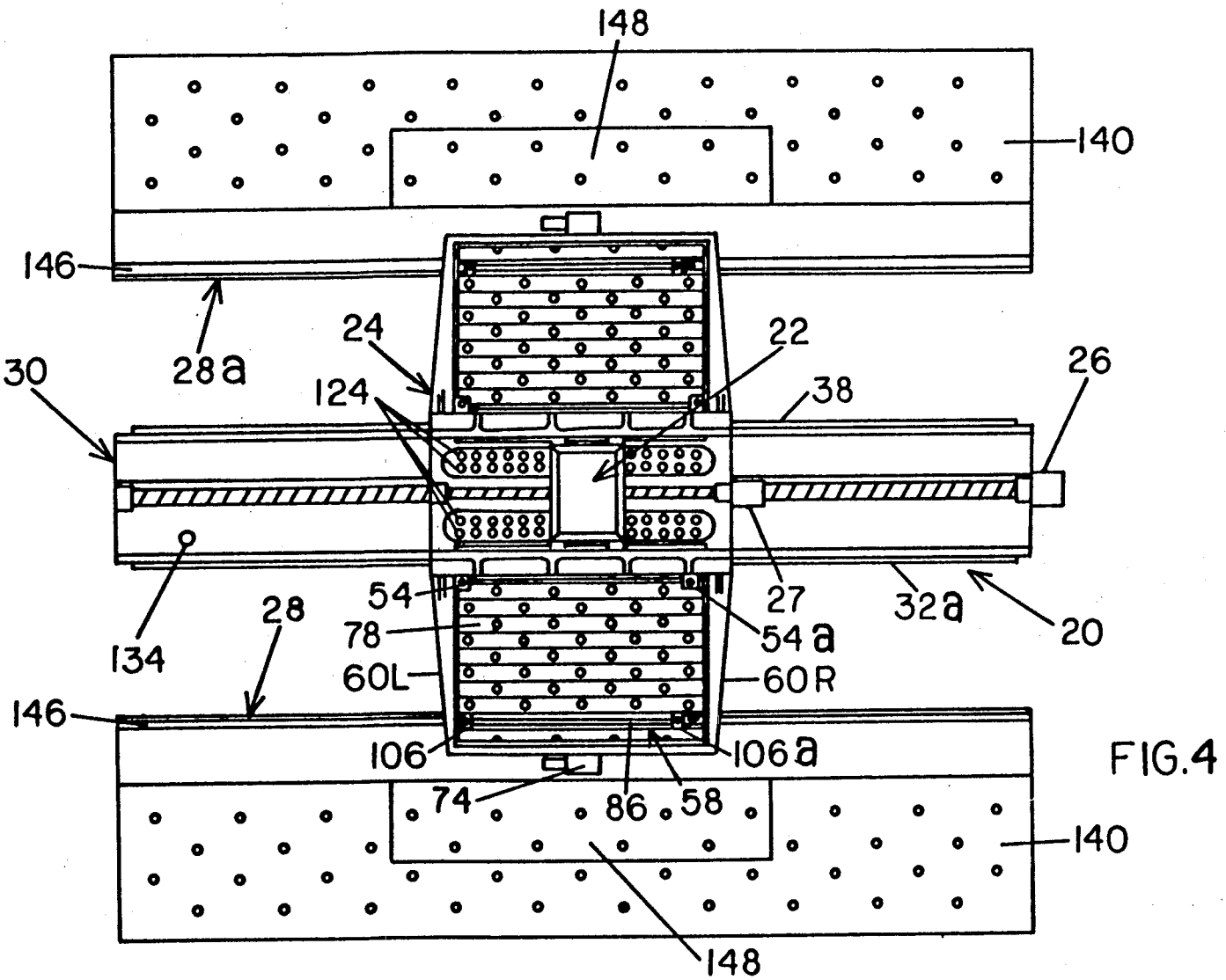
FIG. 4 is a top plan view.

The manner of loading and unloading the linear punch press with a workpiece, not shown, is identical to that of present type punch presses and may be manual or automatic. The X and Y positioning frame 24 is moved to the extreme left, as viewed in the drawings. The workpiece to be punched is placed on the support table 28 adjacent the workpiece clamp 106 and the repositioning clamp 54. The workpiece is then moved into the support frame 30 and located adjacent the Y axis index cylinder 134 (FIG. 4). The workpiece clamp 106 and the repositioning clamp 54 are activated and grip the workpiece to prevent its unauthorized movement. Y axis servo drive 74 revolves the screw 72 and moves the bar 86 and conveyor 78 as needed in the Y axis direction. The linear guides 70 and 70a keep the bar 86 aligned.

The repositioning clamp 54a and workpiece clamp 106a are similarly activated and grip the workpiece. When the "on" button is activated X axis index cylinder 134 and repositioning clamps 54 and 54a are released.

The workpiece is moved to the first punch position by the Y axis servomotor drive 74 moving the workpiece in the Y axis direction while the X axis servomotor drive assembly 26 moves the positioning frame 24 in the X axis direction. The X axis linear slides 32 and 32*a* (FIG. 5) received by the X axis linear slides 82, on the frame 50 sides, (FIG. 8) prevents concave or convex bending of the punch support 38 during workpiece punching action. The stepper motors 114 and 114*a* rotate the interposer cams 116 and 116*a* by the cam shafts 120 and 120*a* into position for striking the punch rams 118. The workpiece will be punched when either cam 116 or 116*a* is actuated. When cam 116 has been selected the punching ram cylinder 110 drives the interposer 108 downward striking punching ram 118 to produce the desired configuration in the workpiece.

While the workpiece is moving in the X and Y axes directions the punch head 22 is moved in the X axis direction by the X axis servomotor drive 27 through punch programmed positions. When the Y axis servo drive 74 moves the workpiece to its maximum forward position, repositioning clamps 54 and 54*a* grip the workpiece. Clamps 106 and 106*a* are released and moved to an outward position by the Y axis servo drive 74. The work-piece is then reclamped by the clamps 106 and 106*a* and repositioning clamps 54 and 54*a* are released and the workpiece is moved in the Y axis direction through the support frame 30 by the conveyor 78. After the workpiece has been punched, the conveyor and workpiece clamps on the unload side of the frame 30 move the workpiece beyond the positioning frame 24 to release it.

A controller 31 (FIG. 3) is provided for controlling the operation of the punch press 20, The controller 31 is a four axis computer numerical control (CNC). The X and Y axes positioning frame 24 and punch head 22 are closed loop servo design. This insures that all machine drives are at the prescribed positions prior to punching a workpiece. The controller 31 also controls all other major machine functions such as the punching head 22, workpiece clamps 106 and 106*a*, repositioning clamps 54 and 54*a* and various other automatic functions which are used on the punch press. The controller 31 continuously monitors all important machine junctions and parameters and automatically diagnoses operating errors and/or out of limit conditions, disables affected components and displays the appropriate error message on a visual readout. The controller 31 is designed to operate on piece part data supplied from paper tape, an operators panel keyboard or a remote source such as another computer by a built in communication path.

Obviously the invention is susceptible to changes or alterations without defeating its practicability. Therefore, I do not wish to be confined to the preferred embodiment shown in the drawings and described herein.

I claim:

1. A linear punch press for processing a workpiece, comprising:

upright elongated central frame means having coextensive punch and die supports disposed in superposed spaced relation defining opposing side surfaces and having coextensive linear guides adjacent the upper limit of said side surfaces, said punch and die supports including a plurality of fixed position punch and die adaptors cooperatively supported, respectively, in vertically spaced axial alignment by said punch and die supports intermediate their ends;

a workpiece support table having a linear guide coextensive with said central frame means disposed in lateral parallel spaced-apart relation on respective sides of said central frame means;

X and Y axes workpiece positioning frame means including workpiece supporting conveyor means extending transversely of and supported by said central frame means and said support table linear guides;

first and second motor means for moving said positioning frame means in an X axis direction and said conveyor means in a Y axis direction respectively;

punch driving head means slidably supported for movement in an X axis direction within said positioning frame means; and, third motor means for aligning said punch driving head means with selected punch adaptors.

2. The punch press according to claim 1 in which the X and Y axis workpiece positioning frame means includes:

first pairs of workpiece clamps moveable with said positioning frame in an X axis direction; and, second pairs of workpiece clamps supported by and moveable with said conveyor means in a Y axis direction.

3. The punch press according to claim 2 in which the punch driving head means includes:

motor and cam means for driving a punch through a workpiece.

4. The punch press according to claim 1 in which the punch driving head means includes:

motor and cam means for driving a punch through a workpiece.

* * * * *